US008132809B2

(12) United States Patent
Shiraishi et al.

(10) Patent No.: US 8,132,809 B2
(45) Date of Patent: Mar. 13, 2012

(54) FEEDER AND IMAGE FORMING APPARATUS

(75) Inventors: Satoru Shiraishi, Saitama (JP); Yasunobu Gotoh, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 156 days.

(21) Appl. No.: 12/582,381

(22) Filed: Oct. 20, 2009

(65) Prior Publication Data

US 2010/0133739 A1 Jun. 3, 2010

(30) Foreign Application Priority Data

Nov. 28, 2008 (JP) ..... P2008-304289

(51) Int. Cl.
*B65H 1/00* (2006.01)

(52) U.S. Cl. ..... 271/162; 271/164; 271/273; 271/125

(58) Field of Classification Search ..... 271/125, 271/157, 162, 164, 273, 274, 138, 121, 122
See application file for complete search history.

(56) References Cited

U.S. PATENT DOCUMENTS

| | | | | |
|---|---|---|---|---|
| 4,219,192 | A * | 8/1980 | Burke | 271/160 |
| 4,387,889 | A * | 6/1983 | Koyama et al. | 271/10.01 |
| 4,509,737 | A * | 4/1985 | Shiozawa | 271/125 |
| 4,526,358 | A * | 7/1985 | Ura et al. | 271/34 |
| 4,572,498 | A * | 2/1986 | Shiozawa | 271/34 |
| 4,740,817 | A * | 4/1988 | Suzuki et al. | 399/392 |
| 4,793,606 | A * | 12/1988 | Yasuoka et al. | 271/157 |
| 5,172,899 | A * | 12/1992 | Tajima | 271/122 |
| 5,375,826 | A * | 12/1994 | Flores | 271/10.01 |
| 5,470,052 | A * | 11/1995 | Asakawa et al. | 271/118 |
| 5,501,444 | A | 3/1996 | Yukimachi et al. | |
| 5,722,654 | A * | 3/1998 | Sootome et al. | 271/119 |
| 5,842,691 | A * | 12/1998 | Nakamura | 271/122 |
| 5,938,188 | A * | 8/1999 | Nagahara | 271/121 |
| 6,000,689 | A * | 12/1999 | Furuki et al. | 271/10.11 |
| 6,659,449 | B2 * | 12/2003 | Kim | 271/117 |
| 6,695,303 | B2 * | 2/2004 | Okada et al. | 271/9.12 |
| 7,404,555 | B2 * | 7/2008 | Yonemoto | 271/164 |
| 7,416,181 | B2 * | 8/2008 | Murakami et al. | 271/162 |
| 2004/0036207 | A1 * | 2/2004 | Lee et al. | 271/157 |
| 2006/0043664 | A1 * | 3/2006 | Park | 271/9.05 |

FOREIGN PATENT DOCUMENTS

| | | |
|---|---|---|
| JP | 6-255811 | 9/1994 |
| JP | 7-206183 | 8/1995 |
| JP | 07-215493 | 8/1995 |
| JP | 7-215515 | 8/1995 |
| JP | 09-183526 | 7/1997 |

(Continued)

*Primary Examiner* — Michael McCullough
*Assistant Examiner* — Howard Sanders
(74) *Attorney, Agent, or Firm* — Morgan, Lewis & Bockius LLP

(57) ABSTRACT

A feeder that stores a sheet used to form an image in an image forming apparatus main body and that is configured to be drawn out from the image forming apparatus main body in a perpendicular direction to a sheet conveying direction. The feeder includes: a separation member that is in press-contact with a sheet feed member disposed in the image forming apparatus main body for separating a stored sheet in cooperation with the sheet feed member; an arm part that is attached to the separation member, the separation member being rotatably attached through the arm part; and a rotation mechanism that rotates the separation member downward through the arm part and releases the press contact with the sheet feed member when the feeder is drawn out from the image forming apparatus main body.

8 Claims, 15 Drawing Sheets

FOREIGN PATENT DOCUMENTS

| | | |
|---|---|---|
| JP | 11-322095 | 11/1999 |
| JP | 2000-025966 | 1/2000 |
| JP | 2001-097572 | 4/2001 |
| JP | 2002-019987 | 1/2002 |
| JP | 2002-293444 | 10/2002 |
| JP | 2006-347711 | 12/2006 |

* cited by examiner

FEEDER AND IMAGE FORMING APPARATUS

CROSS-REFERENCE TO RELATED APPLICATIONS

This application is based on and claims priority under 35 USC 119 from Japanese Patent Application No. 2008-304289 filed on Nov. 28, 2008.

BACKGROUND

1. Technical Field

This invention relates to a feeder and an image forming apparatus.

2. Related Art

A sheet feed tray for storing sheets used to form an image exists in an image forming apparatus.

If a sheet stored in a sheet feed tray runs out, the user draws out the sheet feed tray from the image forming apparatus and replenishes the sheet storage portion of the drawn-out and exposed sheet feed tray with sheets.

On the other hand, to convey a sheet stored in the sheet feed tray at the image forming time, a pickup roller exerts a sheet feed pressure on a stored sheet and a feed roller and a retard roller exert a separation pressure on a conveyed sheet to separate conveyed sheets overlapping each other.

SUMMARY

According to an aspect of the invention, a feeder that stores a sheet used to form an image in an image forming apparatus main body and that is configured to be drawn out from the image forming apparatus main body in a perpendicular direction to a sheet conveying direction, the feeder includes: a separation member that is in press-contact with a sheet feed member disposed in the image forming apparatus main body for separating a stored sheet in cooperation with the sheet feed member; an arm part that is attached to the separation member, the separation member being rotatably attached through the arm part; and a rotation mechanism that rotates the separation member downward through the arm part and releases the press contact with the sheet feed member when the feeder is drawn out from the image forming apparatus main body.

BRIEF DESCRIPTION OF THE DRAWINGS

Exemplary embodiment(s) of the present invention will be described in detail based on the following figures, wherein.

DETAILED DESCRIPTION

An exemplary embodiment of the invention will be discussed in detail with reference to the accompanying drawings.

To begin with, an image forming apparatus 1 having a nip release mechanism of a retard roller as a separation member will be discussed with reference to FIGS. 1A and 1B.

Figure 1A:
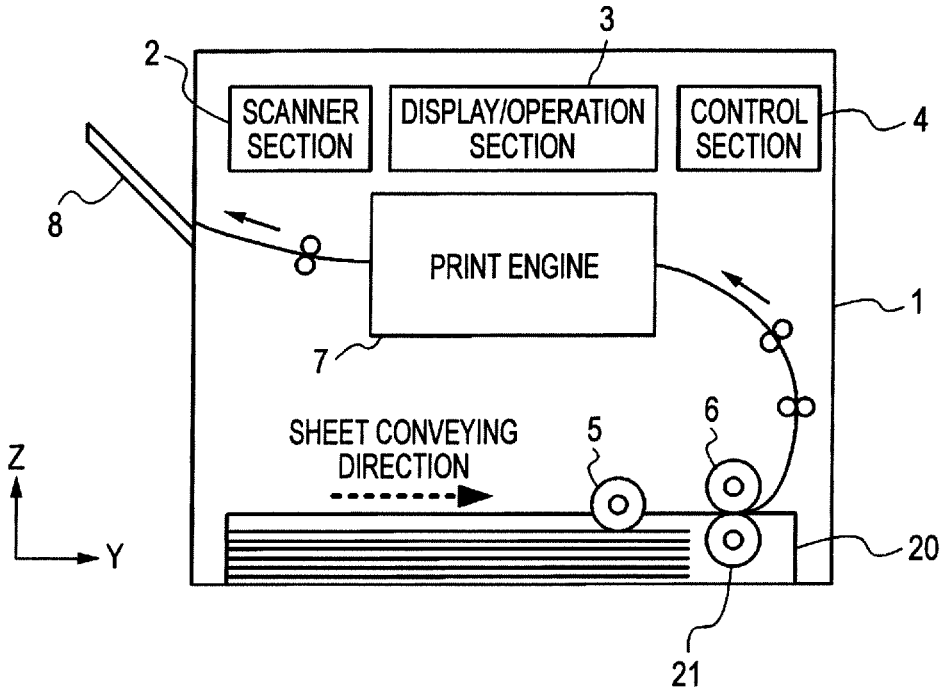
FIGS. 1A and 1B are configuration drawings to show an outline of an image forming apparatus 1.
Figure 1B:
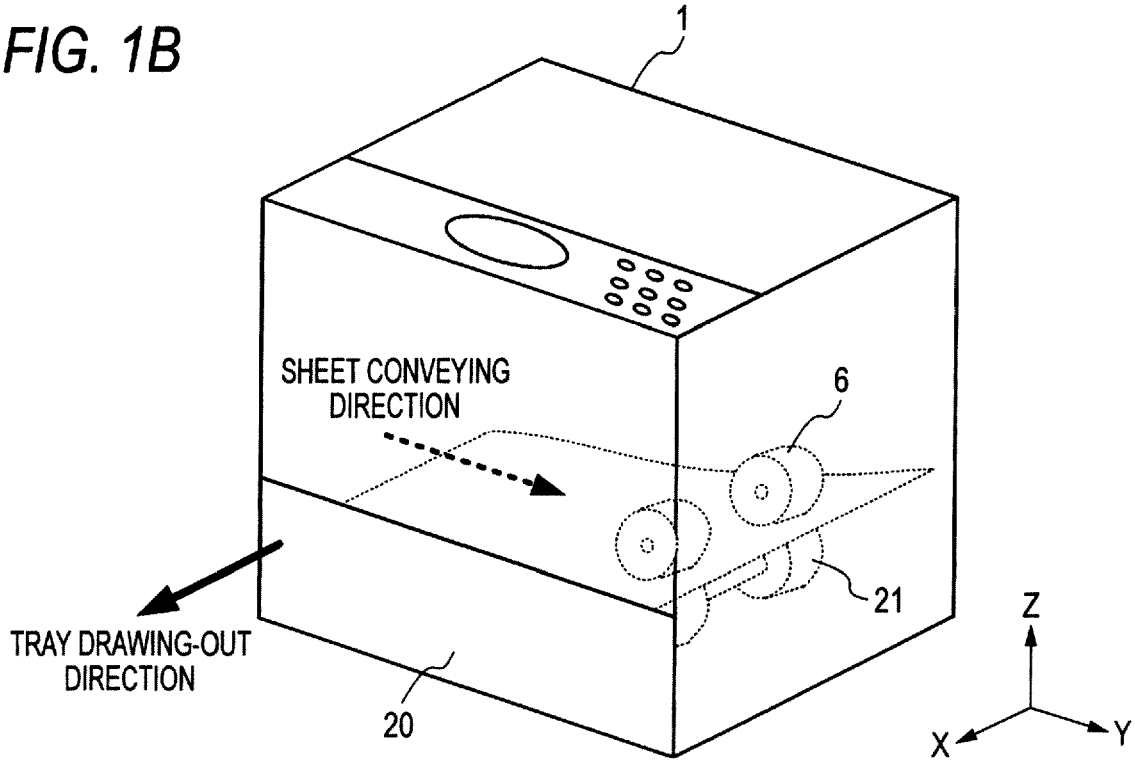

FIG. 1A is a configuration drawing to show an outline of the image forming apparatus 1, and FIG. 1B is a schematic drawing to show a sheet storage tray and a sheet conveying direction.

The image forming apparatus 1 has a scanner section 2, a display/operation section 3, a control section 4, a pickup roller 5, a feed roller 6, a print engine 7, a sheet feed tray 20, and a retard roller 21.

The scanner section 2 is a unit for applying light to a document and reading an image of the document as image data.

The display/operation section 3 is implemented as a liquid crystal touch panel for displaying information for the user and accepting a command from the user.

The control section 4 controls the whole image forming apparatus 1.

The pickup roller 5 delivers a sheet in a sheet conveying direction from the sheet feed tray 20.

The feed roller 6 and the retard roller 21 placed in the sheet feed tray 20 enter a nip state in which they are in press-contact with each other at a predetermined separation pressure when the sheet feed tray 20 is completely housed in the image forming apparatus 1.

The feed roller 6 rotates in a direction feeding the sheet delivered by the pickup roller 5 from the sheet feed tray 20 in the sheet conveying direction.

A drive system of the retard roller 21 is provided with a torque limiter. If two or more sheets enter the nip between the feed roller 6 and the retard roller 21, the retard roller 21 rotates backward for returning any other sheet than the conveyed sheet in the opposite direction to the conveying direction. When one sheet is sandwiched between the feed roller 6 and the retard roller 21, the retard roller 21 rotates in association with the feed roller 6 as the torque limiter is turned off.

When no sheet enters the nip between the feed roller 6 and the retard roller 21, the retard roller 21 also rotates in association with the feed roller 6 as the torque limiter is turned off.

Thus, when the feed roller 6 and the retard roller 21 enter the nip state, the sheet conveyed from the sheet feed tray 20 is conveyed to the print engine 7 one sheet at a time.

The print engine 7 performs processing of forming an image on the sheet conveyed one at a time by the feed roller 6 and the retard roller 21 in the nip state.

The sheet on which an image has been formed by the print engine 7 is discharged to a sheet discharge tray 8.

The sheet feed tray 20 is a sheet storage case that can be placed in and drawn out from the image forming apparatus 1; it contains the retard roller 21.

The sheet feed tray 20 is pushed into and is drawn out from the image forming apparatus 1 along a drawing-out rail.

As shown in FIG. 1B, the tray drawing-out direction to draw out the sheet feed tray 20 from the image forming apparatus 1 is at the right angle to the sheet conveying direction of conveying a sheet in the sheet feed tray 20. When the sheet feed tray 20 is completely housed in the image forming apparatus 1 and it is possible to form an image on a sheet in the sheet feed tray 20, the feed roller 6 placed in the main body of the image forming apparatus 1 and the retard roller 21 placed in the sheet feed tray 20 are in a nip state.

However, to draw out and separate the sheet feed tray 20 from the image forming apparatus 1 because of sheet replacement, etc., the image forming apparatus 1 has a configuration in which the nip state between the feed roller 6 and the retard roller 21 is released as the sheet feed tray 20 is drawn out from the main body of the image forming apparatus 1, so that an interference problem of the feed roller 6 and the retard roller 21 rubbing against each other when the sheet feed tray 20 is placed and is drawn out is solved.

Next, a state in which the nip state is released when the sheet feed tray 20 is placed and is drawn out will be discussed with reference to FIG. 2.

Figure 2:
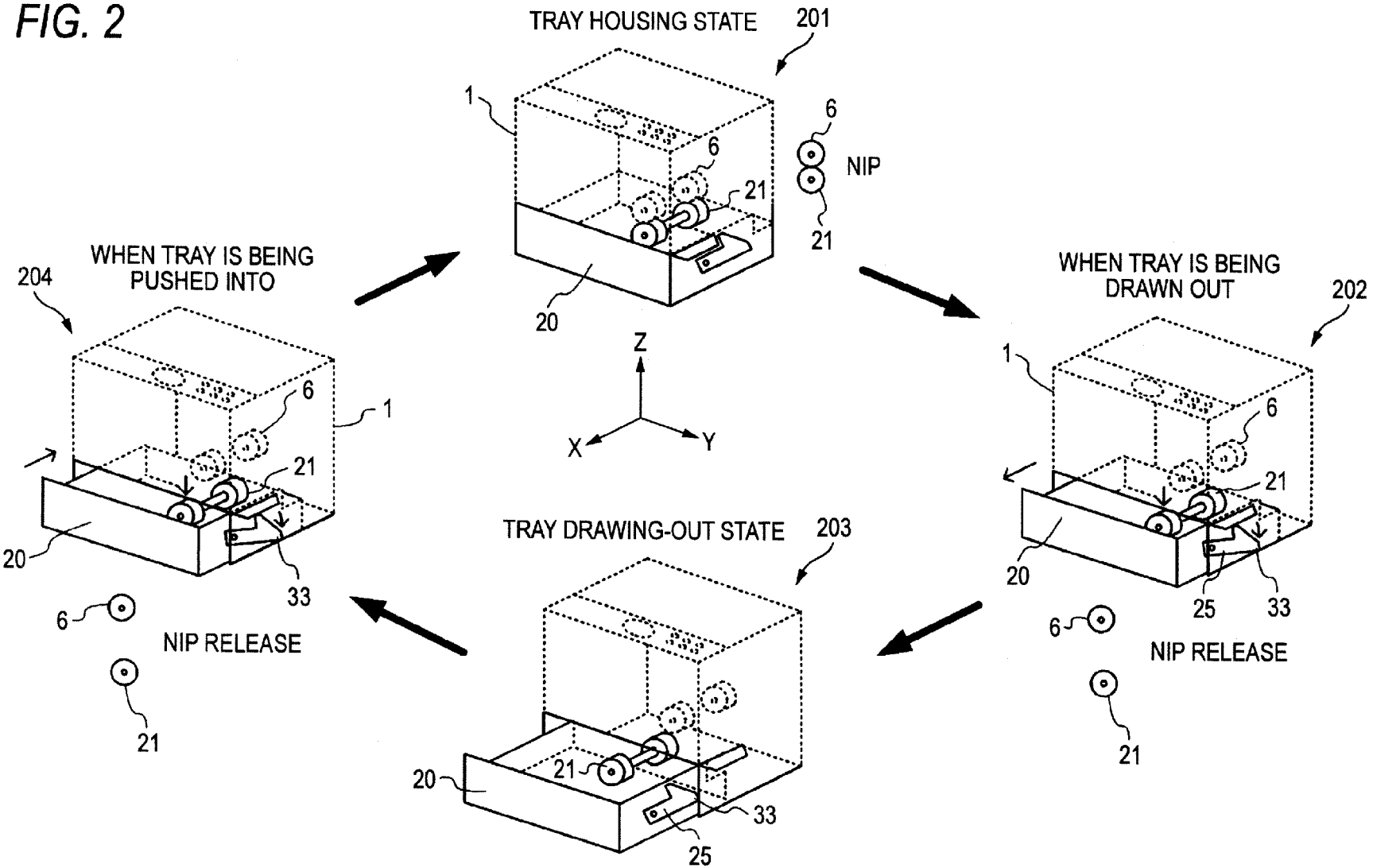
FIG. 2 is a schematic drawing to show a state in which a nip state is released when a sheet feed tray 20 is placed and is drawn out.

FIG. 2 is a schematic drawing to show the state in which the nip state is released when the sheet feed tray 20 is placed and is drawn out.

As in a drawing indicated by reference numeral 201, when the sheet feed tray 20 is completely housed in the image forming apparatus 1 so that the sheet feed tray 20 is used and it is made possible to form an image, the feed roller 6 placed in the main body of the image forming apparatus 1 and the retard roller 21 placed in the sheet feed tray 20 are in a nip state in which they are in press-contact with each other at a predetermined separation pressure.

However, when the sheet feed tray 20 is drawn out from the main body of the image forming apparatus 1, a tip 33 of a ratchet component 25 placed in the sheet feed tray 20 moves down and accordingly the retard roller 21 falls as in a drawing indicated by reference numeral 202.

Then, the nip state between the feed roller 6 and the retard roller 21 is released.

When the sheet feed tray 20 is drawn out to a predetermined position, the tip 33 of the ratchet component 25 placed in the sheet feed tray 20 moves up and accordingly the retard roller 21 rises.

When the sheet feed tray 20 is drawn out, then the sheet feed tray 20 is replenished with sheets, etc., and then is pushed into the image forming apparatus 1.

When the sheet feed tray 20 is pushed into a predetermined housing position of the image forming apparatus 1, the tip 33 of the ratchet component 25 placed in the sheet feed tray 20 also moves down and as the tip 33 of the ratchet component 25 moves down, the retard roller 21 also falls as in a drawing indicated by reference numeral 204.

Thus, when the sheet feed tray 20 is drawn out and is pushed, the tip 33 of the ratchet component 25 moves down and accordingly the retard roller 21 falls, so that the retard roller 21 placed in the sheet feed tray 20 and the feed roller 6 placed in the main body of the image forming apparatus 1 do not come in contact with each other and the sheet feed tray 20 is drawn out and pushed smoothly.

Next, the retard roller 21, the ratchet component 25, etc., placed in the sheet feed tray 20 will be discussed with reference to FIG. 3.

Figure 3:
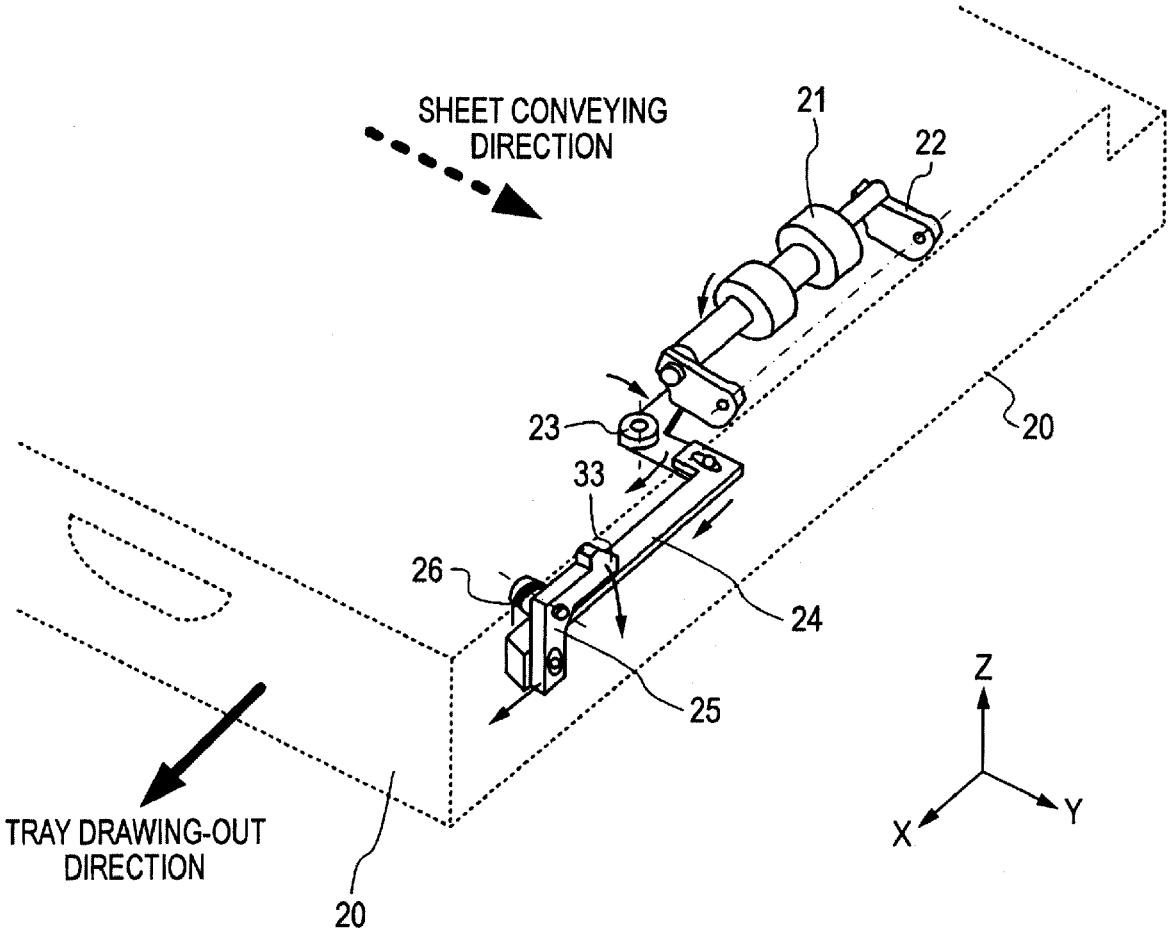
FIG. 3 is a schematic drawing to show various components placed in the sheet feed tray 20.

FIG. 3 is a schematic drawing to show the retard roller 21, the ratchet component 25, etc., placed in the sheet feed tray 20.

As shown in FIG. 3, the retard roller 21, an assembly 22, a rotation component 23, a component 24, the ratchet component 25, and a spring 26 are placed in the sheet feed tray 20.

The spring 26 pulls the tip 33 of the ratchet component 25 so that the tip points upward.

The ratchet component 25 makes a rotation move at a predetermined angle with the rotation axis as a supporting point, whereby the tip 33 portion of the ratchet component 25 moves up or down relative to the sheet feed tray 20.

The spring 16 adds a force to the ratchet component 25 at all times so that the ratchet component 25 makes a rotation move in a direction in which the tip 33 of the ratchet component 25 moves up.

The component 24 is placed so as to move back and forth in the tray drawing-out direction as the tip 33 of the ratchet component 25 moves up and down.

The rotation component 23 is placed so as to make a rotation move with a supporting point as an axis as the component 24 moves back and forth in the tray drawing-out direction.

The assembly 22 is an assembly including the retard roller 21 and is placed so as to make a rotation move up and down with a supporting point as an axis with a rotation move of the rotation component 23.

Thus, as the tip 33 of the ratchet component 25 placed in the sheet feed tray 20 moves up and down, the component 24 moves back and forth in the tray drawing-out direction, the rotation component 23 makes a rotation move, and the assembly 22 makes a rotation move up and down.

Since the retard roller 21 is placed in the assembly 22, the retard roller 21 moves up and down relative to the sheet feed tray 20 as the assembly 22 makes a rotation move up and down.

This means that the retard roller 21 moves up and down as the tip 33 of the ratchet component 25 moves up and down.

Next, the components in the sheet feed tray 20 in the nip state between the retard roller 21 and the feed roller 6 and those in the sheet feed tray 20 when the nip state is released will be discussed with reference to FIGS. 4A and 4B.

Figure 4A:
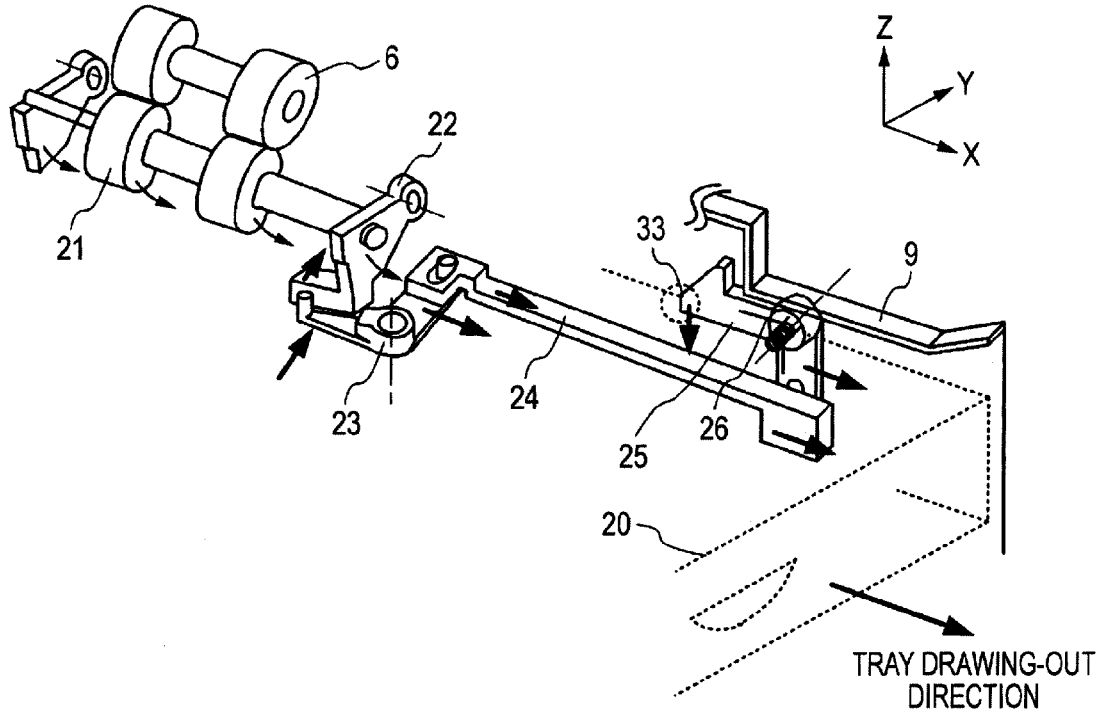
FIGS. 4A and 4B are schematic drawings to show various components placed in the sheet feed tray 20.
Figure 4B:
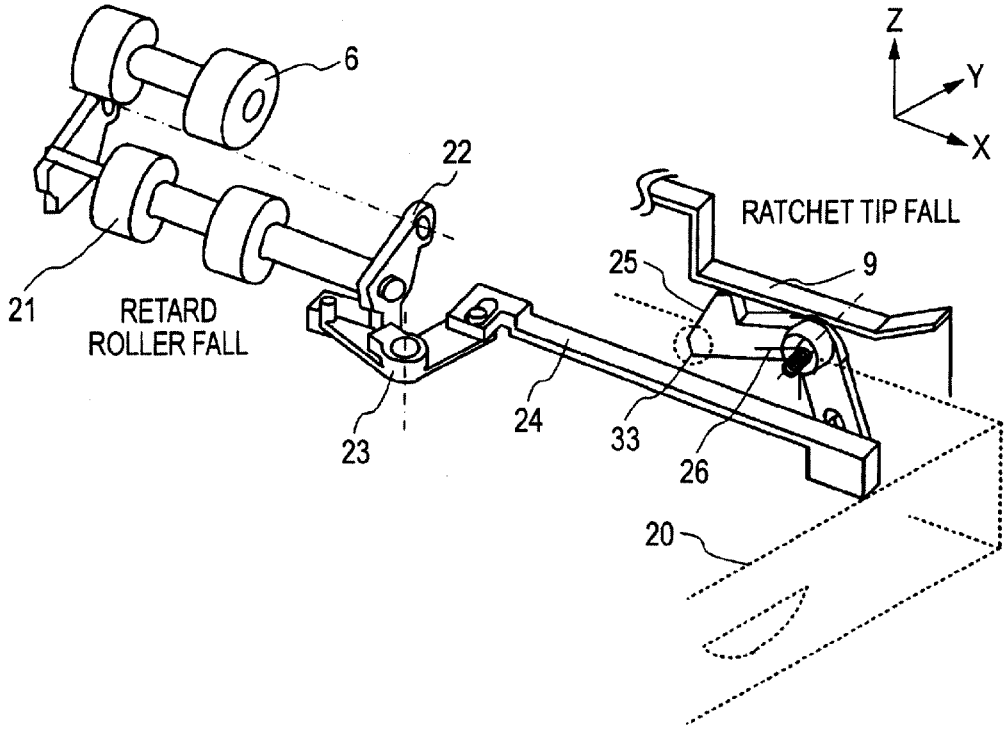

FIGS. 4A and 4B are schematic drawings to show various components placed in the sheet feed tray 20 and the retard roller 21 nipped with the feed roller 6; FIG. 4A is a schematic drawing to show the case where the sheet feed tray 20 is completely housed in the image forming apparatus 1 and the feed roller 6 and the retard roller 21 are in a nip state; and FIG. 4B is a schematic drawing to show the case where the sheet feed tray 20 is drawn out and the nip state between the feed roller 6 and the retard roller 21 is released.

When the sheet feed tray 20 is completely housed in the image forming apparatus 1 and an image can be formed as a sheet is conveyed from the sheet feed tray 20, the feed roller 6 and the retard roller 21 placed in the image forming apparatus 1 are in the nip state as shown in FIG. 4A.

However, when drawing out the sheet feed tray 20 from the image forming apparatus 1 starts, the tip 33 of the ratchet component 25 placed in the sheet feed tray 20 comes in contact with a convex portion 9 placed in the main body of the image forming apparatus 1 and as the sheet feed tray 20 is drawn out, the tip 33 of the ratchet component 25 is brought down by the convex portion 9 as shown in FIG. 4B.

That is, the sheet feed tray 20 makes a parallel move relative to the main body of the image forming apparatus 1, so that the ratchet component 25 placed in the sheet feed tray 20 also makes a parallel move relative to the convex portion 9 placed in the image forming apparatus 1. At the time, a protrusion portion of the tip 33 of the ratchet component 25 passes through below the convex portion 9 placed in the main body of the image forming apparatus 1, as shown in FIGS. 4A and 4B. To allow the ratchet component 25 to pass through below the convex portion 9, the tip 33 of the ratchet component 25 needs to move down. Thus, to draw out the sheet feed tray 20 by a force of a human being, mechanically, when the ratchet component 25 of the sheet feed tray 20 passes through below the convex portion 9 placed in the image forming apparatus 1, the ratchet component 25 makes a rotation move and the tip 33 of the ratchet component 25 moves down.

As shown in FIG. 4B, if the tip 33 of the ratchet component 25 moves down, the assembly 22 moves down as described above, so that the nip state between the retard roller 21 and the feed roller 6 is released.

Next, the nip state between the retard roller 21 and the feed roller 6 is released will be discussed with reference to FIGS. 5A and 5B.

Figure 5A:
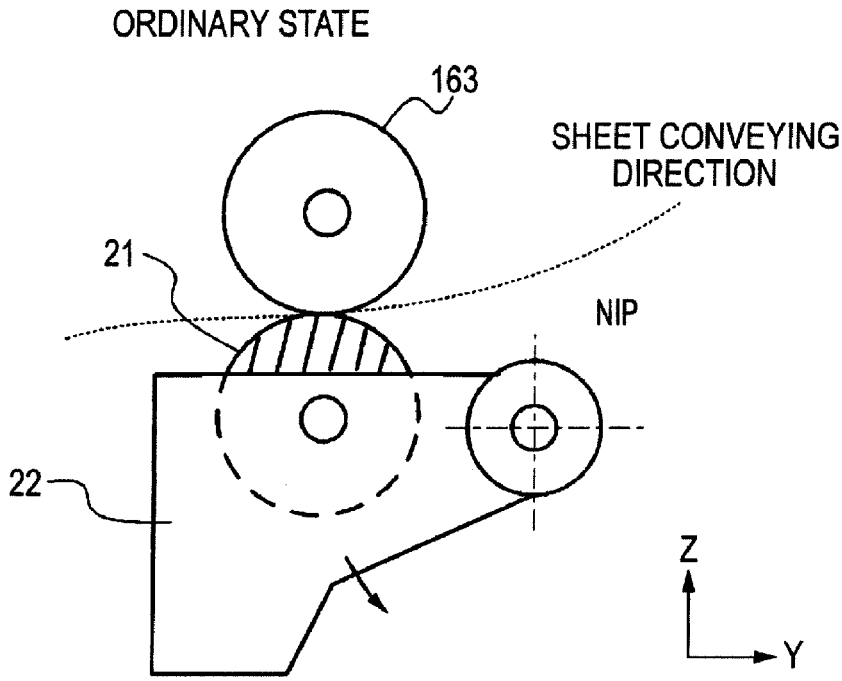
FIGS. 5A and 5B are schematic drawings to show a nip state between a retard roller 21 and a feed roller 6.
Figure 5B:
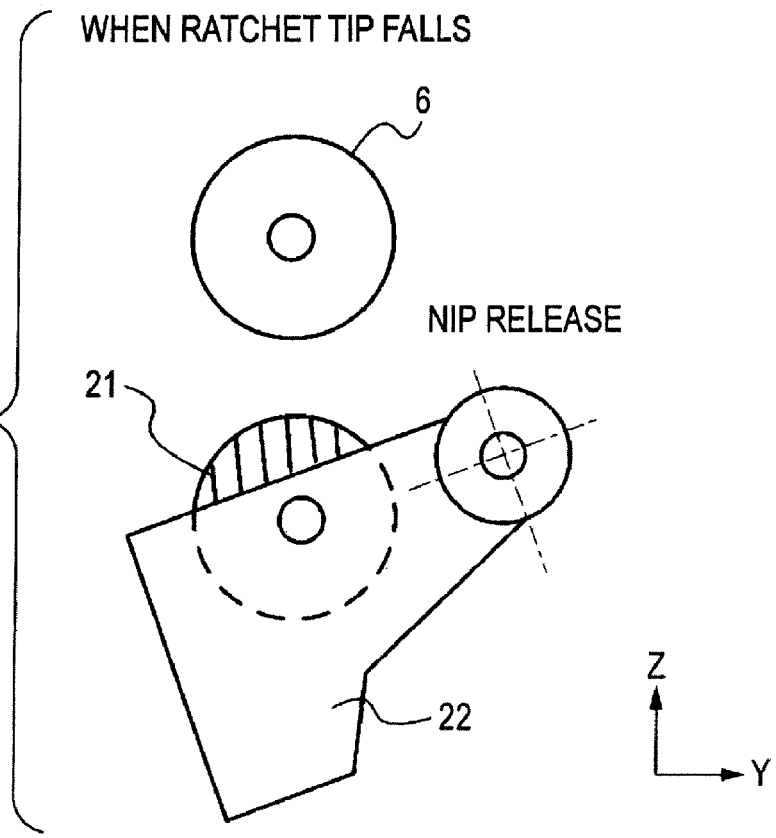

FIGS. 5A and 5B are schematic drawings to show the nip state between the retard roller 21 and the feed roller 6; FIG. 5A is a schematic drawing to show a nip state; and FIG. 5B is a schematic drawing to show a nip release state.

As shown in FIG. 5A, in the nip state between the retard roller 21 and the feed roller 6, the feed roller 6 and the retard roller 21 are in press-contact with each other at a predetermined separation pressure.

However, when the assembly 22 moves down as the tip 33 of the ratchet component 25 falls, the feed roller 6 and the retard roller 21 are brought away from each other and the nip state is released.

The assembly 22 and the retard roller 21 are integrated and the retard roller 21 also falls as the assembly 22 falls.

When the sheet feed tray 20 is drawn out or is pushed, the feed roller 6 placed in the main body of the image forming apparatus 1 and the retard roller 21 placed in the sheet feed tray 20 to be drawn out or pushed are at a distance from each other as shown in FIG. 5B. Thus, when the sheet feed tray 20 is drawn out or is pushed, the feed roller 6 and the retard roller 21 do not come in contact with each other.

Next, how the retard roller 21 moves down when the sheet feed tray 20 is drawn out from the image forming apparatus 1 will be discussed with reference to FIGS. 6A, 6B and 6C.

Figure 6A:
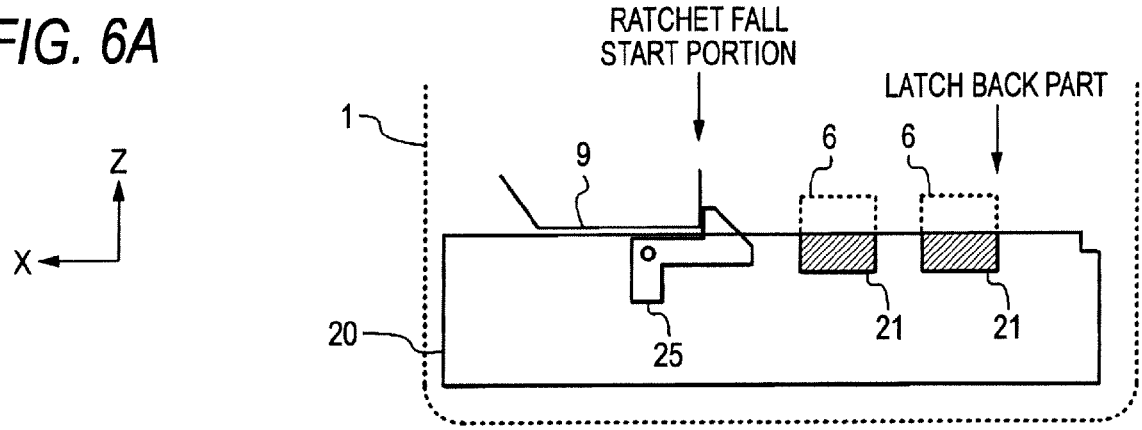
FIGS. 6A, 6B and 6C are schematic drawings to show how the retard roller 21 moves down when the sheet feed tray 20 is drawn out.
Figure 6B:
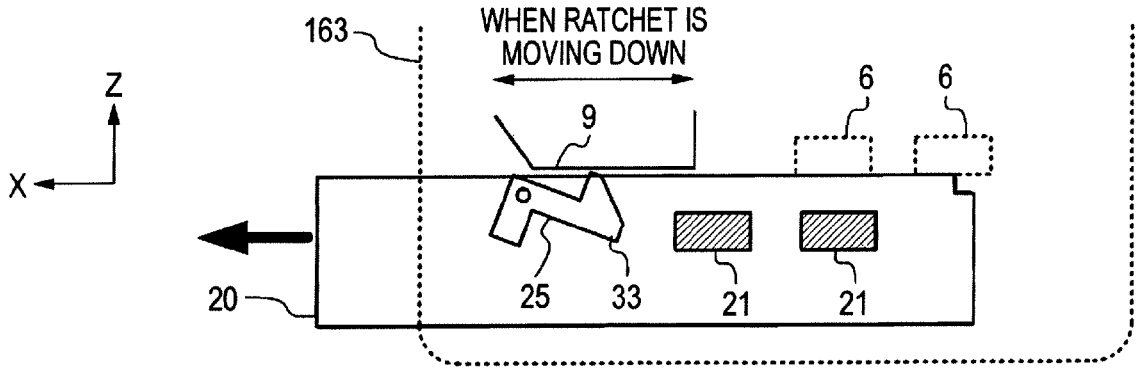
Figure 6C:
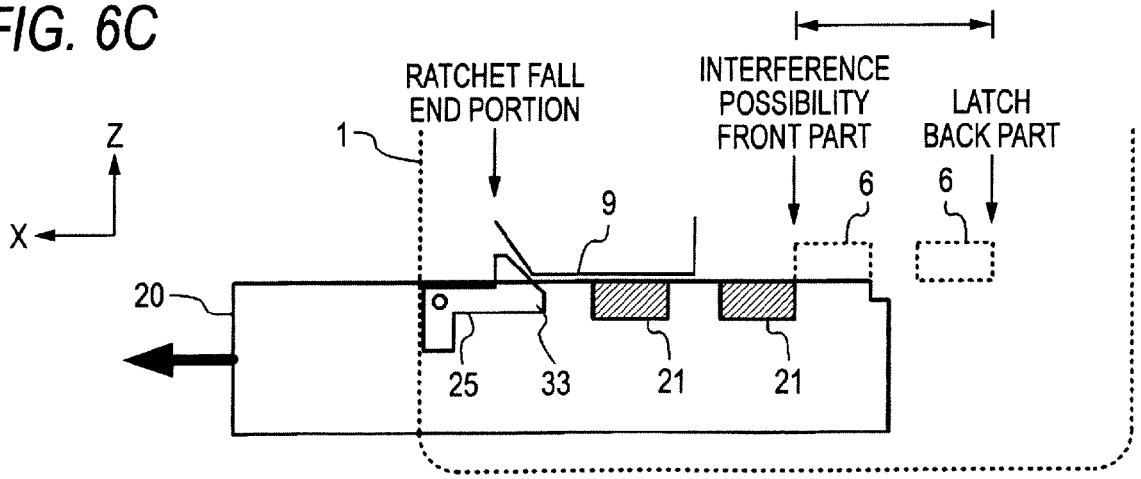

FIGS. 6A, 6B and 6C are schematic drawings to show how the retard roller 21 moves down when the sheet feed tray 20 is drawn out; FIG. 6A is a schematic drawing to show a state in which the sheet feed tray 20 is completely housed in the image forming apparatus 1; FIG. 6B is a schematic drawing to show a state in which the sheet feed tray 20 is drawn out from the image forming apparatus 1 and the retard roller 21 moves down; and FIG. 6C is a schematic drawing to show a state in which the sheet feed tray 20 is drawn out to a predetermined position from the image forming apparatus 1 and the retard roller 21 rises.

As shown in FIG. 6A, when the sheet feed tray 20 is completely housed in the image forming apparatus 1, the feed roller 6 and the retard roller 21 are in the nip state, a sheet stored in the sheet feed tray 20 is conveyed, and an image can be formed.

To draw out the sheet feed tray 20 from the image forming apparatus 1, the tip 33 of the ratchet component 25 placed in the sheet feed tray 20 passes through below the convex portion 9 placed in the main body of the image forming apparatus 1 as the tip 33 moves down. The sheet feed tray 20 has the mechanism in which the retard roller 21 moves down if the ratchet component 25 moves down. Thus, the retard roller 21 moves down, the nip state between the feed roller 6 and the retard roller 21 is released, and the sheet feed tray 20 is drawn out.

When the sheet feed tray 20 is drawn out to a predetermined length, the state in which the tip 33 of the ratchet component 25 placed in the sheet feed tray 20 passes through below the convex portion 9 terminates and the tip 33 of the ratchet component 25 moves up, as shown in FIG. 6C.

When the tip 33 of the ratchet component 25 moves up, the retard roller 21 moves up. When the sheet feed tray 20 is drawn out and the retard roller 21 moves up, the feed roller 6 and the retard roller 21 are placed where they do not come in contact with each other. Thus, there is no problem if the sheet feed tray 20 is drawn out as it is.

When the sheet feed tray 20 is drawn out, the retard roller 21 moves down in the case where the tip 33 of the ratchet component 25 is moved down by the convex portion 9. Thus, the length in which the state in which the retard roller 21 moves down is maintained depends on the length of the convex portion 9 in the drawing-out direction of the sheet feed tray.

Next, the length of the convex portion 9 for maintaining the state in which the tip 33 of the ratchet component 25 is moved down will be discussed with reference to FIG. 7.

Figure 7:
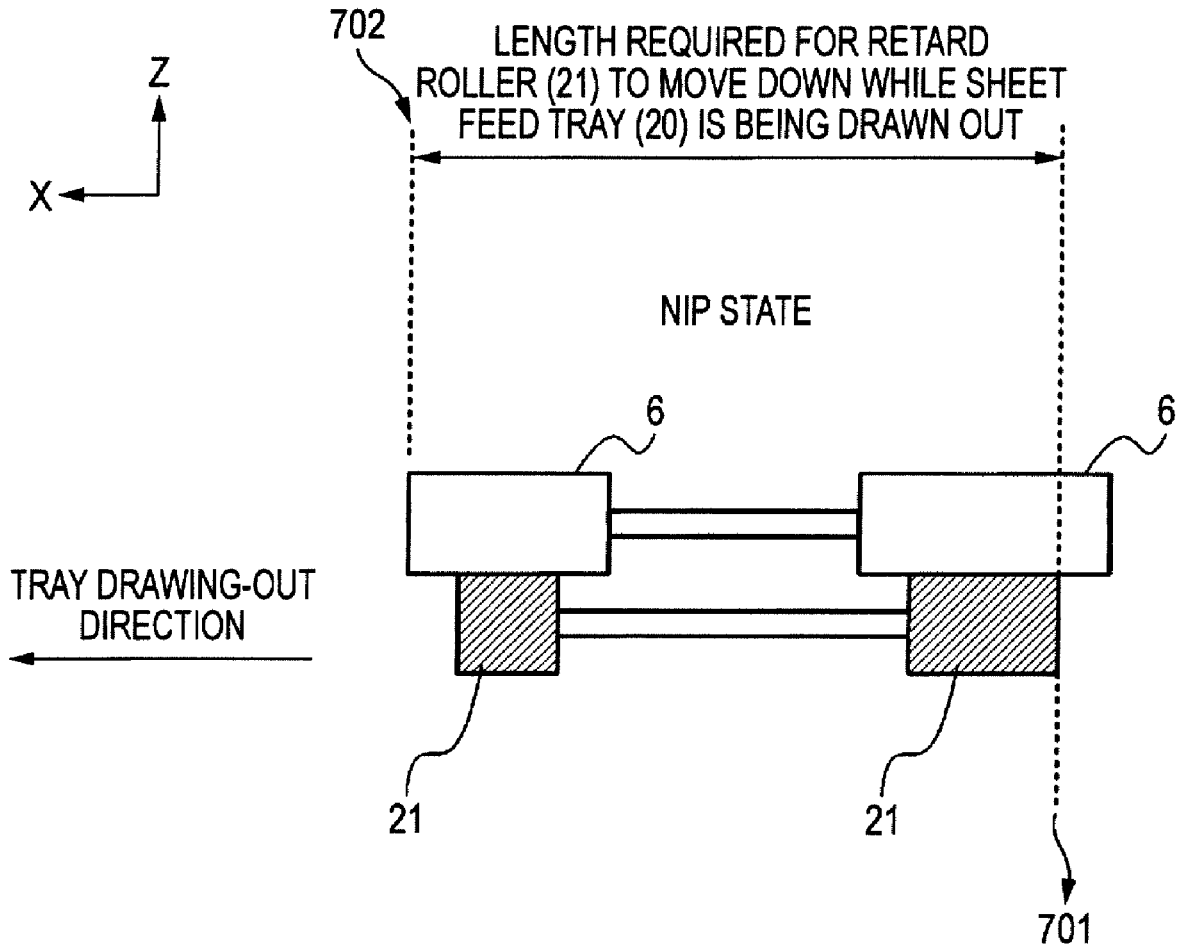
FIG. 7 is a schematic drawing to show the positional relationship between the feed roller 6 and the retard roller 21 in a nip state.

FIG. 7 is a drawing to show the positional relationship between the feed roller 6 and the retard roller 21 in the nip state.

When the feed roller 6 and the retard roller 21 are in the nip state as in FIG. 7, a length from an opposite end part (reference number 701) of the retard roller 21 to the sheet feed tray drawing out port to an end part (reference number 702) of the feed roller 6 on the side of the sheet feed tray drawing out port becomes necessary to maintain the state in which the retard roller 21 moves down when the sheet feed tray 20 is drawn out.

Then, the length of the convex portion 9 for moving down the tip 33 of the ratchet component 25 becomes equal to or greater than the length from the opposite end part (reference number 701) of the retard roller 21 to the sheet feed tray drawing out port to the end part (reference number 702) of the feed roller 6 on the side of the sheet feed tray drawing out port.

Next, how the retard roller 21 moves down when the sheet feed tray 20 is pushed into the image forming apparatus 1 will be discussed with reference to FIGS. 8A, 8B and 8C.

Figure 8A:
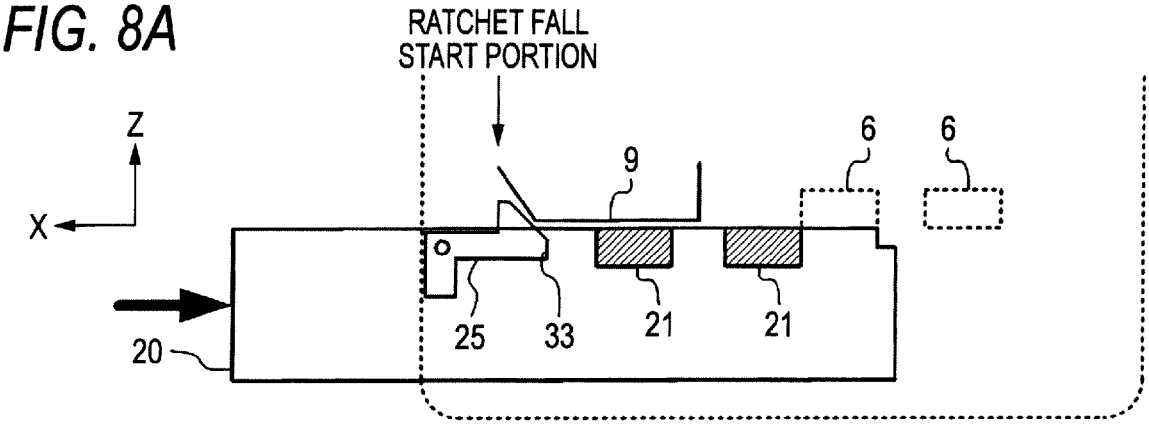
FIGS. 8A, 8B and 8C are schematic drawings to show how the retard roller 21 moves down when the sheet feed tray 20 is pushed.
Figure 8B:
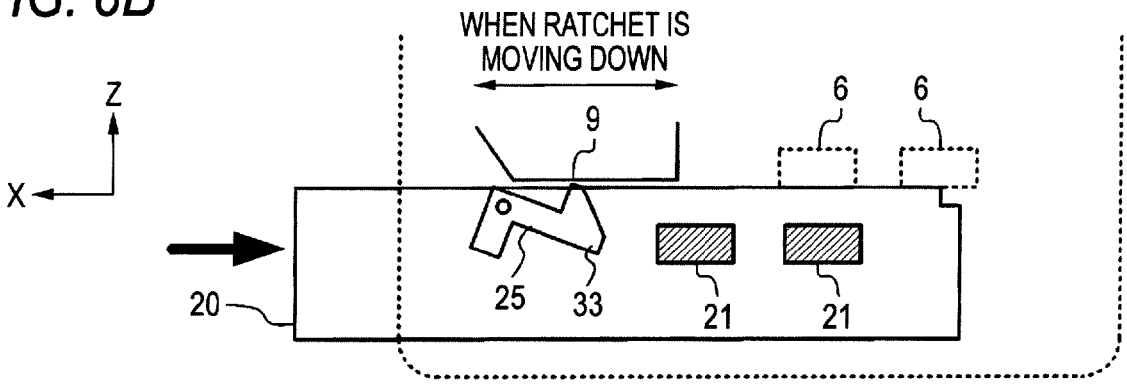
Figure 8C:
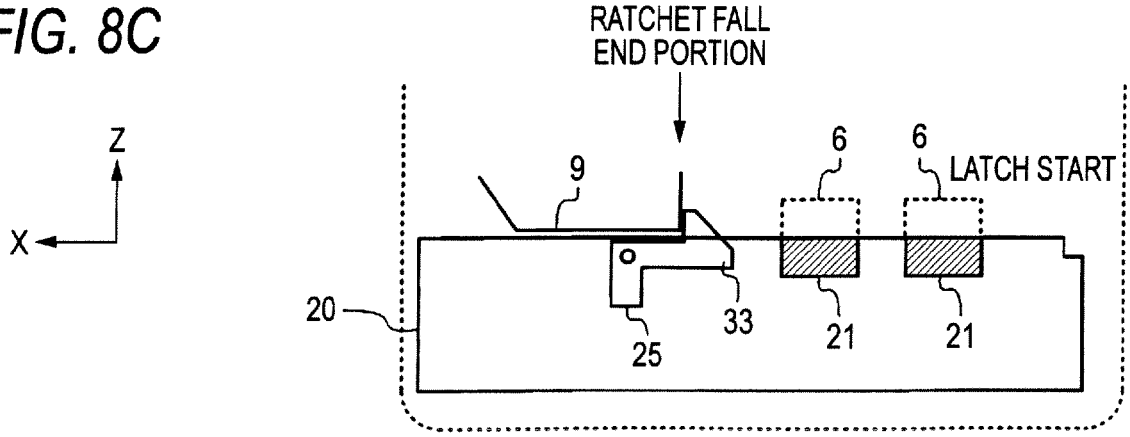

FIGS. 8A, 8B and 8C are schematic drawings to show how the retard roller 21 moves down when the sheet feed tray 20 is pushed; FIG. 8A is a schematic drawing to show a state in which the sheet feed tray 20 is drawn out from the image forming apparatus 1 until the tip 33 of the ratchet component 25 moves up; FIG. 8B is a schematic drawing to show a state in which the sheet feed tray 20 is pushed into the image forming apparatus 1 and the tip 33 of the ratchet component 25 placed in the sheet feed tray 20 moves down; and FIG. 8C is a schematic drawing to show that the sheet feed tray 20 is completely housed in the image forming apparatus 1 and the retard roller 21 and the feed roller 6 are in the nip state.

As shown in FIG. 8A, the tip 33 of the ratchet component 25 placed in the sheet feed tray 20 moves up and the sheet feed tray 20 is not housed in the image forming apparatus 1.

In this state, the retard roller 21 moves up and if the state in which the retard roller 21 moves up is maintained as it is and the sheet feed tray 20 is pushed, the retard roller 21 and the feed roller 6 come in contact with each other and there is the fear of damage to the components.

Then, if the sheet feed tray 20 is pushed to a predetermined position, the tip 33 of the ratchet component 25 placed in the sheet feed tray 20 passes through below the convex portion 9 placed in the main body of the image forming apparatus 1 and thus the tip 33 moves down and the retard roller 21 moves down.

Then, to push the sheet feed tray 20, it is pushed in a state in which the retard roller 21 moves down, the retard roller 21 and the feed roller 6 do not come in contact with each other, and the sheet feed tray 20 is pushed into the image forming apparatus 1.

The convex portion is formed so that the tip 33 of the ratchet component 25 moves up in a state in which the sheet feed tray 20 is pushed into the image forming apparatus 1 to the end in the pushing direction and the sheet feed tray 20 is completely housed in the image forming apparatus 1.

Consequently, when the sheet feed tray 20 is completely housed in the image forming apparatus 1, the ratchet component 25 moves up and the retard roller 21 rises, so that the feed roller 6 and the retard roller 21 are placed in the nip state.

Next, a protective cover for holding the assembly with which the retard roller 21 placed in the sheet feed tray 20 is integrated will be discussed with reference to FIGS. 9A and 9B.

Figure 9A:
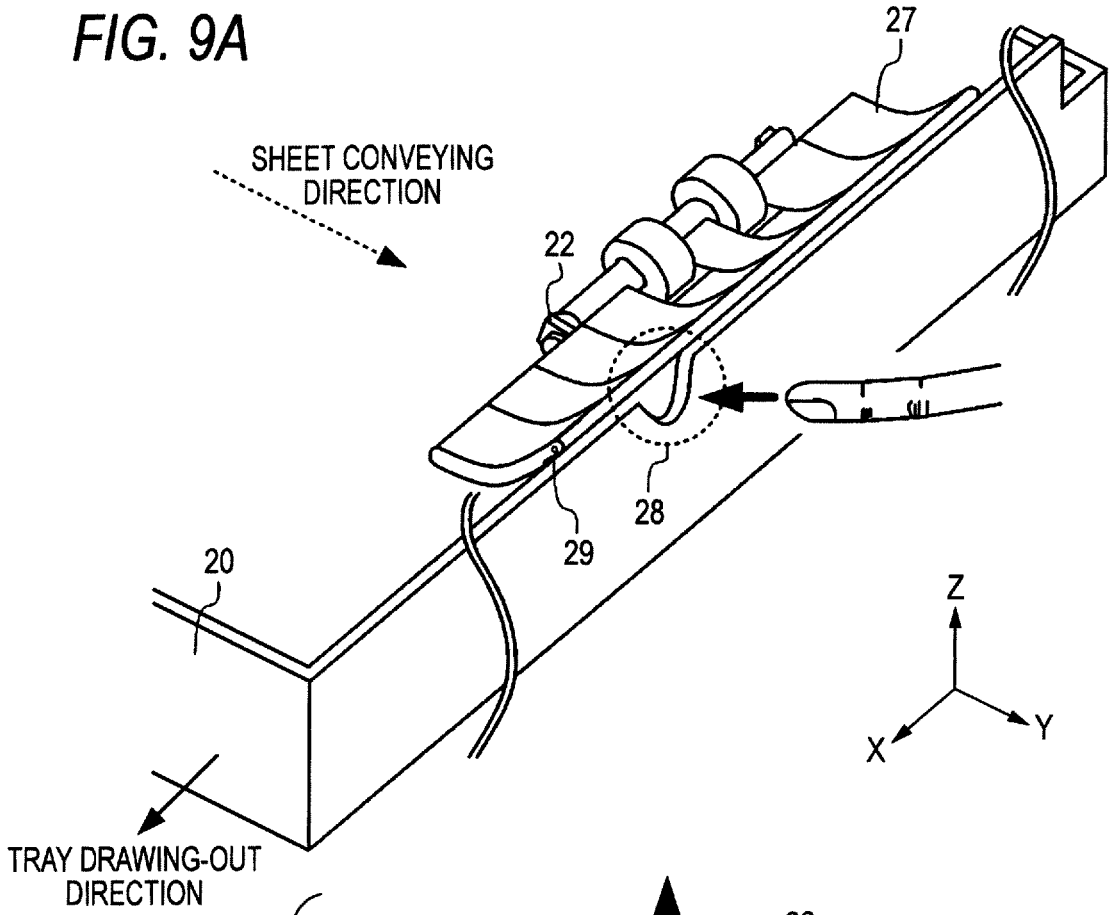
FIGS. 9A and 9B are schematic drawings to show a protective cover 27 and a finger insertion hole 28.
Figure 9B:
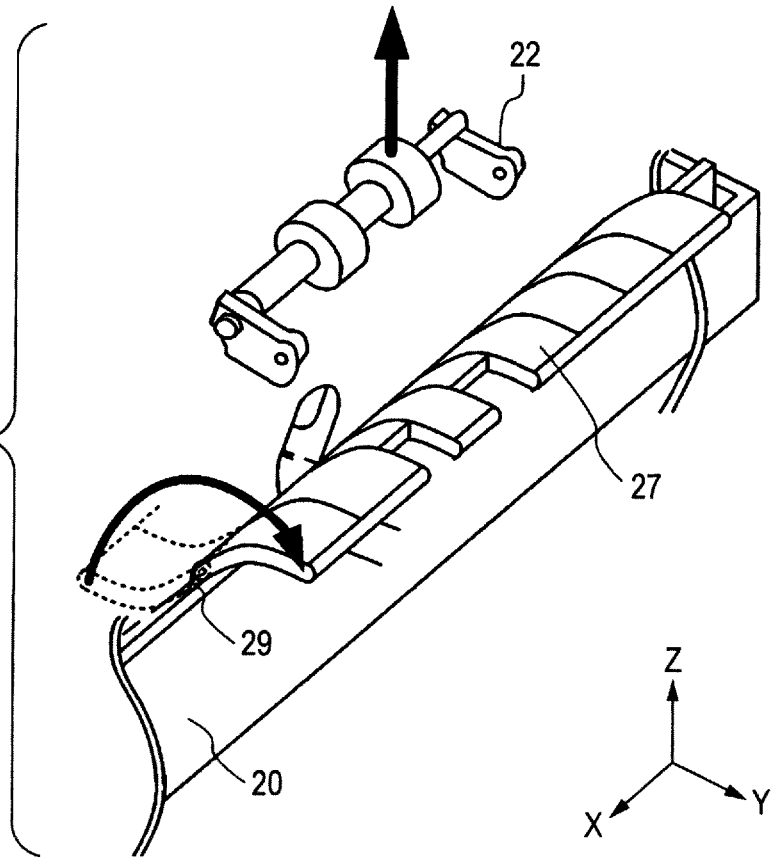

FIGS. 9A and 9B are schematic drawings to show a protective cover 27 placed in the sheet feed tray 20 and a finger insertion hole 28 to open the protective cover; FIG. 9A is a schematic drawing to show a state in which the protective cover 27 is closed and the assembly 22 is housed in the sheet feed tray 20; and FIG. 9B is a schematic drawing to show a state in which the protective cover 27 is opened with a finger inserted into the finger insertion hole 28 provided in the sheet feed tray 20.

As shown in FIG. 9A, the protective cover 27 housing the assembly 22 with which the retard roller 21 is integrated and the finger insertion hole 28 into which a finger is inserted to open the protective cover 27 are placed in the sheet feed tray 20.

The finger insertion hole 28 is formed by providing a notch in the sheet feed tray 20 and is shaped for allowing a finger to be inserted, as shown in FIGS. 9A and 9B.

When a finger is inserted into the finger insertion hole 28 of the sheet feed tray 20 and the protective cover 27 is opened, the protective cover 27 rotates with the joint part to the sheet feed tray 20 as an axis and pops up, enabling the user to take out the assembly 22.

The rotation axis of the protective cover 27 points in the perpendicular direction to the sheet conveying direction.

When the protective cover 27 is thus opened, the user is enabled to take out the assembly 22; the assembly 22 is taken out upward as shown in FIG. 9B.

A spring 29 is placed in the protective cover 27 and is joined to the sheet feed tray 20.

The spring 29 is placed in a state in which it adds a force in a direction opposite to the direction of opening the protective cover 27 with a finger inserted from the finger insertion hole 28, namely, in the direction of closing the protective cover as shown in FIG. 9A.

Figure 10:
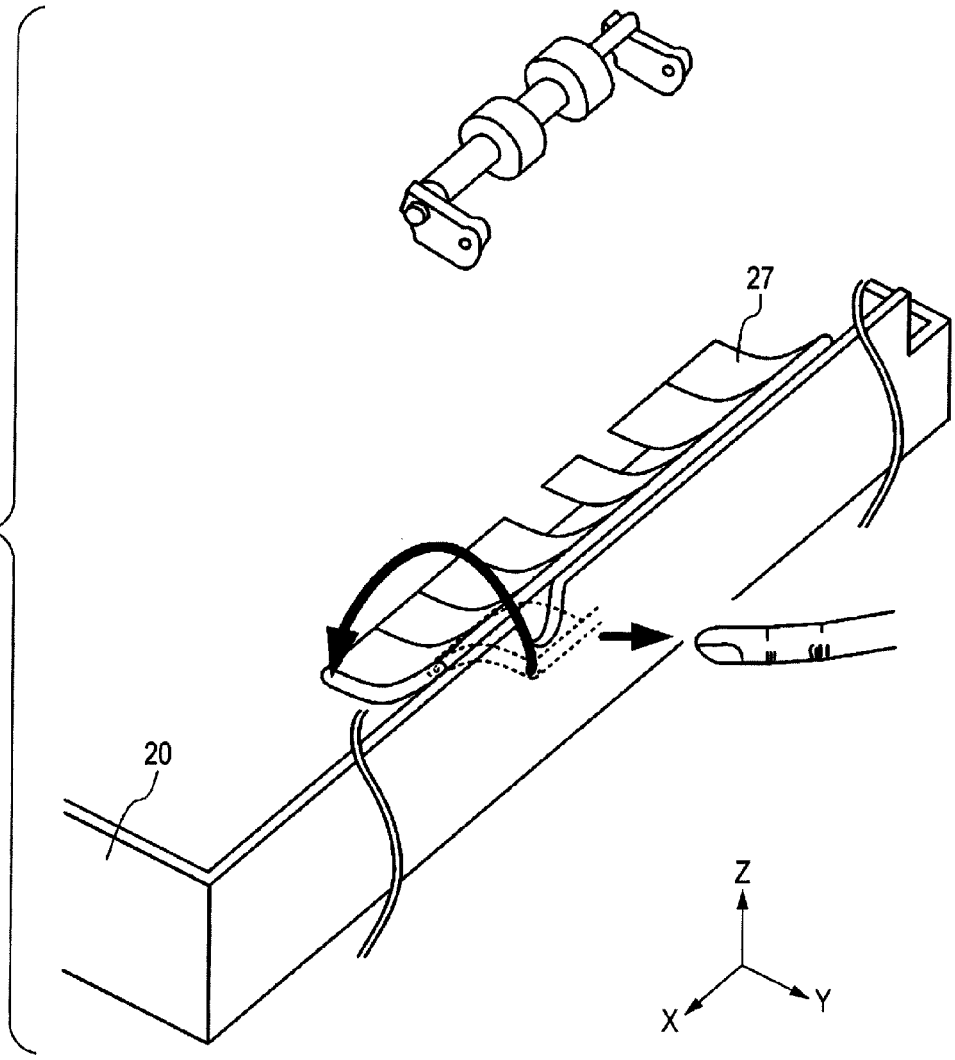
FIG. 10 is a schematic drawing to show how the protective cover 27 is closed.

When the finger inserted into the finger insertion hole 28 is pulled out from the finger insertion hole 28, the protective cover 27 opened as shown in FIG. 9B rotates with the joint part as an axis and moves down to the former closed state as shown in FIG. 10.

The finger is pulled out from the finger insertion hole 28, whereby the protective cover 27 is automatically closed by the spring 29. Thus, when the sheet feed tray 20 is pushed into the image forming apparatus 1, a collision between the protective cover 27 and the front cover of the image forming apparatus 1 caused by forgetting about closing the protective cover 27 is prevented.

Thus, the assembly 22 placed in the sheet feed tray 20 is easily replaced as a finger is inserted from the finger insertion hole 28 and the protective cover 27 is opened.

Since abrasion of the retard roller 21 is intense, easy replacing of the assembly 22 is convenient for the user.

Thus, when the retard roller 21 is placed in the sheet feed tray 20, the sheet feed tray 20 can be placed in and removed from the image forming apparatus 1 and thus the retard roller 21 integrated with the assembly 22 is easy to replace.

Next, the structure of the image forming apparatus 1 in which the sheet feed tray 20 is housed will be discussed with reference to FIG. 11.

Figure 11:
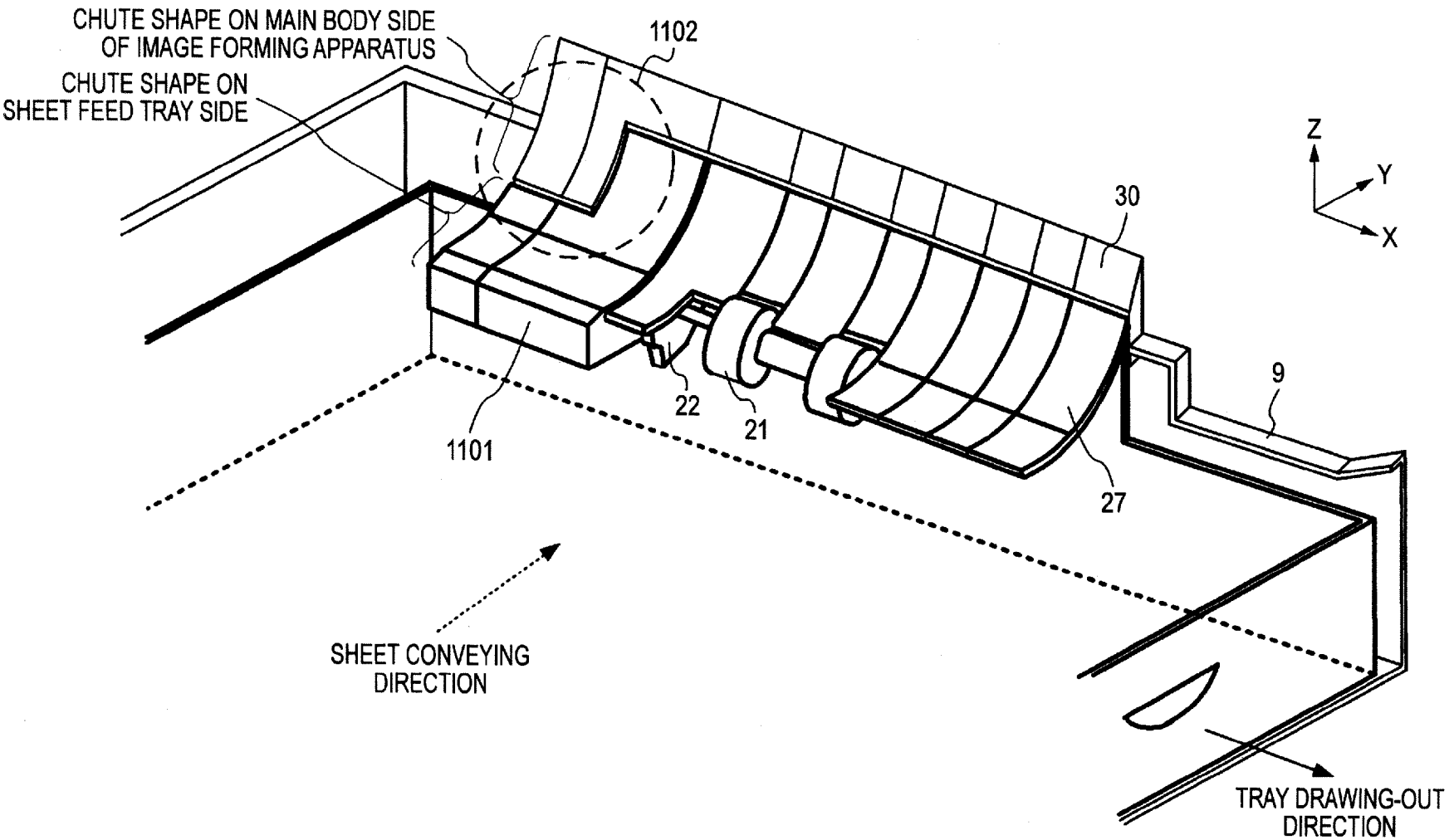
FIG. 11 is a schematic drawing to show a chute shape made up of the sheet feed tray 20 and the image forming apparatus 1.

FIG. 11 is a schematic drawing to show a sheet conveying chute shape made up of the main body of the image forming apparatus 1 and the sheet feed tray 20 in a state in which the sheet feed tray 20 is completely housed in the image forming apparatus 1. However, components of the ratchet component 25, etc., are not shown.

As shown in FIG. 11, the chute shape made up of the image forming apparatus 1 and the sheet feed tray 20 in one piece is formed to convey a sheet stored in the sheet feed tray 20 to the print engine 7 placed above the sheet feed tray 20.

The protective cover 27 of the sheet feed tray 20 forms the chute shape and a component 30 formed with the chute shape is placed in the image forming apparatus 1 of the sheet conveying destination of the protective cover 27.

The chute shape for conveying a sheet to the print engine 7 is formed not only in the protective cover 27, but also in the sheet feed tray 20 in the opposite direction to the tray drawing-out direction of the protective cover (reference number 1101).

The chute shape projects upward so as to introduce a sheet upward for the purpose of conveying the sheet to the upward print engine.

However, the chute shape of the sheet feed tray 20 of the image forming apparatus 1 is formed so that a part of the chute shape of the back side (the side in the opposite direction to the tray drawing-out direction) of the image forming apparatus 1 is formed on the main body side of the image forming apparatus 1 (reference number 1102).

That is, as indicated by the reference number 1102 in FIG. 11, the projecting portion forming the chute shape of the sheet feed tray 20 is made lower than any other portion and the main body side of the image forming apparatus 1 bears the chute shape in the lower part.

Thus, the back side portion of the sheet feed tray 20 is made lower than others (reference number 1102).

Next, the chute shape made lower of the sheet feed tray 20 when the sheet feed tray 20 is drawn out from the image forming apparatus 1 will be discussed with reference to FIG. 12.

Figure 12:
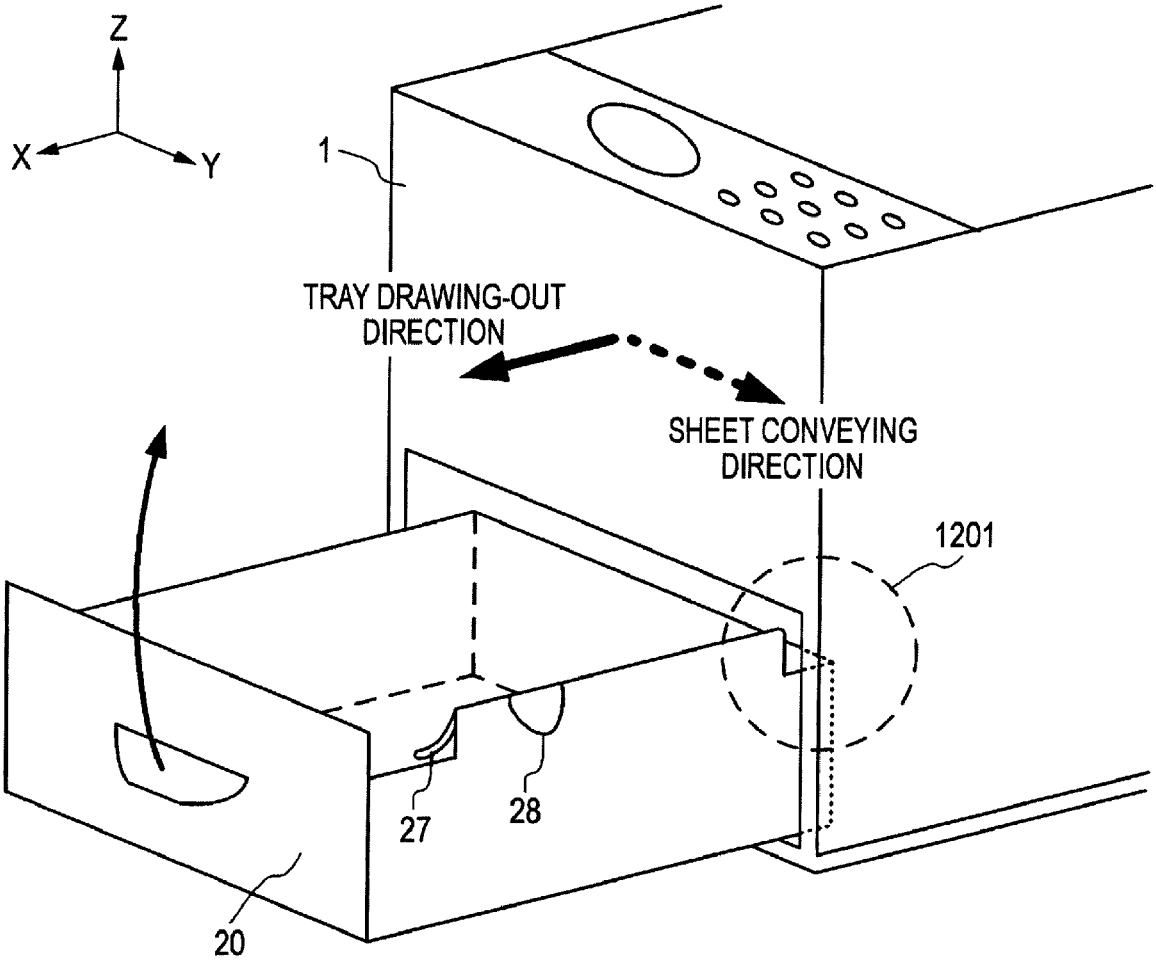
FIG. 12 is a schematic drawing to show a state in which the sheet feed tray 20 has been drawn out from the image forming apparatus 1.

FIG. 12 is a schematic drawing to show a state in which the sheet feed tray 20 has been drawn out from the image forming apparatus 1.

As shown in FIG. 12, the chute shape on the back side of the sheet feed tray 20 is formed lower than others (reference number 1201).

Thus, when the sheet feed tray 20 is separated from the image forming apparatus 1, the projecting chute shape of the sheet feed tray 20 is prevented from coming in contact with the image forming apparatus 1 leading to occurrence of a flaw and damage to the components.

This means that interference between the projecting chute shape of the sheet feed tray 20 and the image forming apparatus 1 is eliminated.

To separate the sheet feed tray 20 from the image forming apparatus 1, the user draws out the sheet feed tray 20 from the image forming apparatus 1 to the end along the drawing-out rail and last lifts up the sheet feed tray 20 to separate from the image forming apparatus 1.

If the back side of the sheet feed tray 20 is low, when the sheet feed tray 20 is lifted up, it is prevented from coming in contact with the image forming apparatus 1.

Next, how the sheet feed tray 20 is separated from the image forming apparatus 1 will be discussed with reference to FIGS. 13A, 13B and 13C.

Figure 13A:
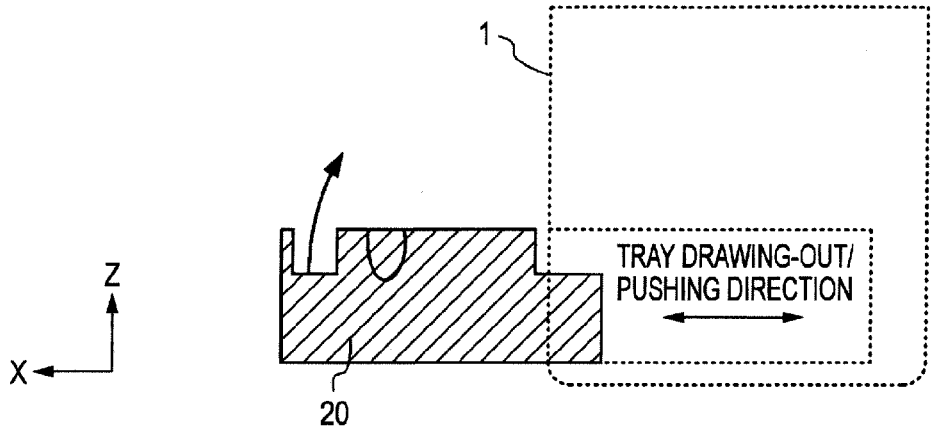
FIGS. 13A, 13B and 13C are schematic drawings to show how the sheet feed tray 20 is separated from the image forming apparatus 1.
Figure 13B:
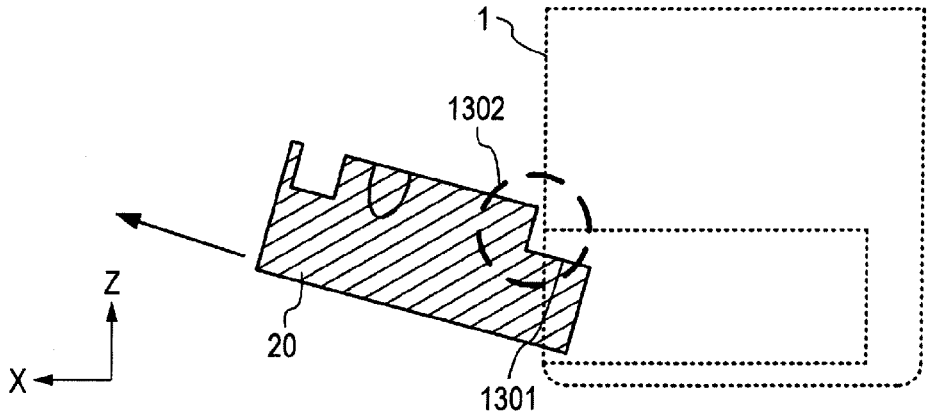
Figure 13C:
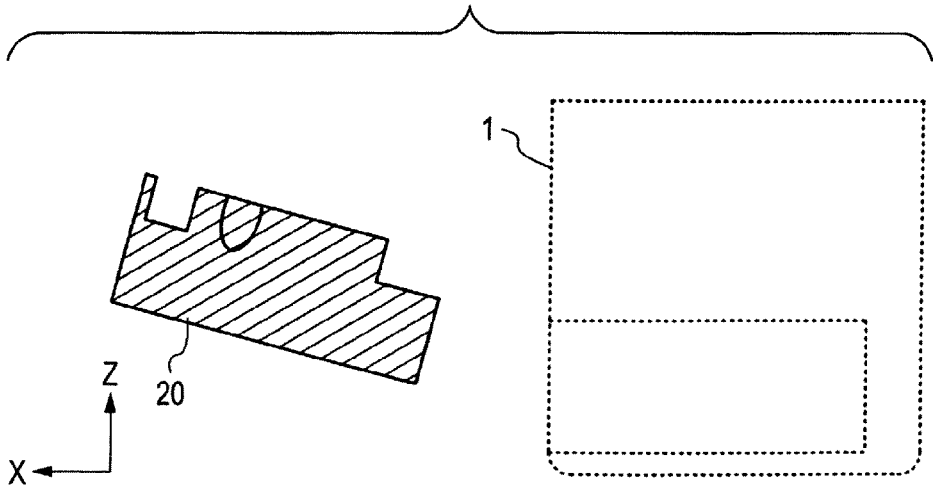

FIGS. 13A, 13B and 13C are schematic drawings to show how the sheet feed tray 20 is separated from the image forming apparatus 1; FIG. 13A is a schematic drawing to show a state in which the sheet feed tray 20 has been drawn out to the end of the drawing-out rail from the image forming apparatus 1; FIG. 13B is a schematic drawing to show a state in which the sheet feed tray 20 is lifted up and is separated from the image forming apparatus 1; and FIG. 13C is a schematic drawing to show a state in which the sheet feed tray 20 has been separated from the image forming apparatus 1. However, components of the ratchet component 25, etc., are not shown.

To separate the sheet feed tray 20 from the image forming apparatus 1, the user draws out the sheet feed tray 20 to the end in the drawing-out direction from the image forming apparatus 1 and then lifts up the sheet feed tray 20, as shown in FIG. 13A.

When the sheet feed tray 20 is lifted up, the chute portion on the back side of the sheet feed tray 20 is low (reference number 1301) and thus does not come in contact with any component of the front cover, etc., of the image forming apparatus 1 (reference number 1302), as shown in FIG. 13B.

Then, the user separates the lifted-up sheet feed tray 20 from the image forming apparatus 1.

The sheet feed tray 20 has been described as a sheet feed tray such that the tip 33 of the ratchet component 25 placed in the sheet feed tray 20 is moved down by the convex portion 9 placed in the main body of the image forming apparatus 1 when the sheet feed tray 20 is drawn out or is pushed into the image forming apparatus 1. However, the sheet feed tray 20 can also be configured so that the tip 33 of the ratchet component 25 is moved down by operation of a handle for drawing out the sheet feed tray 20.

Next, the sheet feed tray 20 configured so that the tip 33 of the ratchet component 25 is moved down by operation of a handle 31 for drawing out the sheet feed tray 20 will be discussed with reference to FIG. 14.

Figure 14:
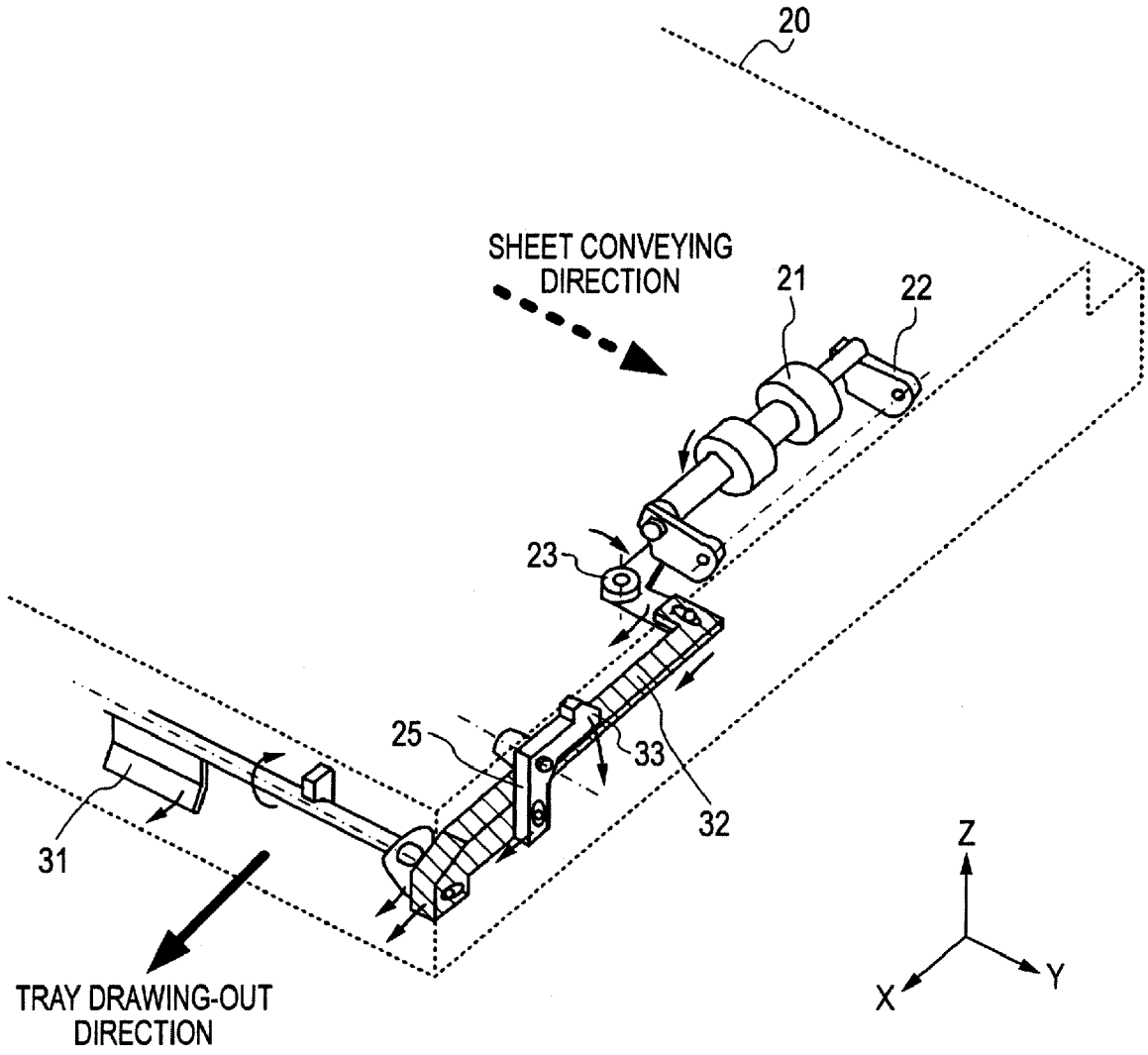
FIG. 14 is a schematic drawing to show various components in the sheet feed tray 20 having a handle 31.

As shown in FIG. 14, the handle 31, a component 32, the ratchet component 25, the rotation component 23, the assembly 22, and the retard roller 21 are placed in the sheet feed tray 20 having the handle 31 (the retard roller 21 is built in the assembly 22).

As shown in FIG. 14, the handle 31 is a part held by a human being when drawing out or pushing the sheet feed tray 20; the user pulls the handle 31 in the tray drawing-out direction, whereby the component 32 is moved back and forth in the tray drawing-out direction.

As the user pulls the handle 31 in the tray drawing-out direction, the component 32 moves in the tray drawing-out direction.

As the component 32 moves in the tray drawing-out direction, it moves down the tip 33 of the ratchet component 25.

As the component 32 moves in the tray drawing-out direction, it causes the rotation component 23 to make a rotation move with a supporting point as an axis.

The assembly 22 is an assembly containing the retard roller 21 is placed so as to make a rotation move up and down with a supporting point as an axis with the rotation move of the rotation component 23.

Next, motion of the components in the sheet feed tray 20 having the handle 31 will be discussed with reference to FIGS. 15A and 15B.

Figure 15A:
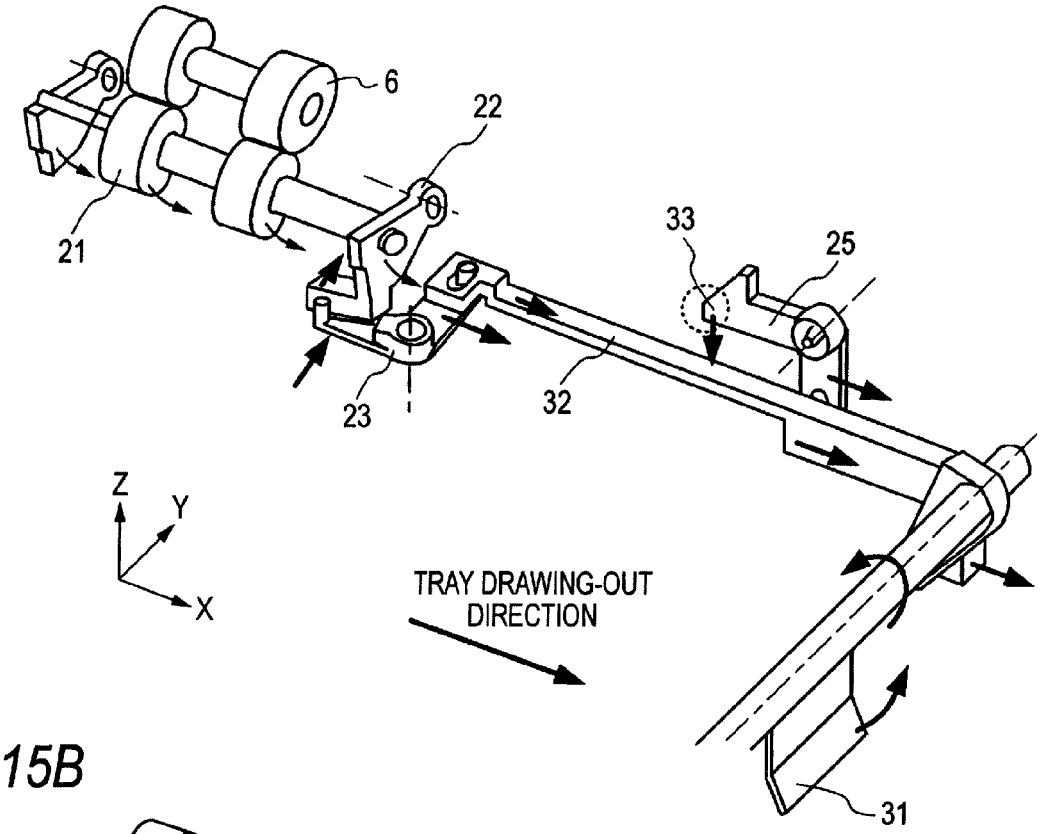
FIGS. 15A and 15B are schematic drawings to show motion of the various components in the sheet feed tray 20 having the handle 31.
Figure 15B:
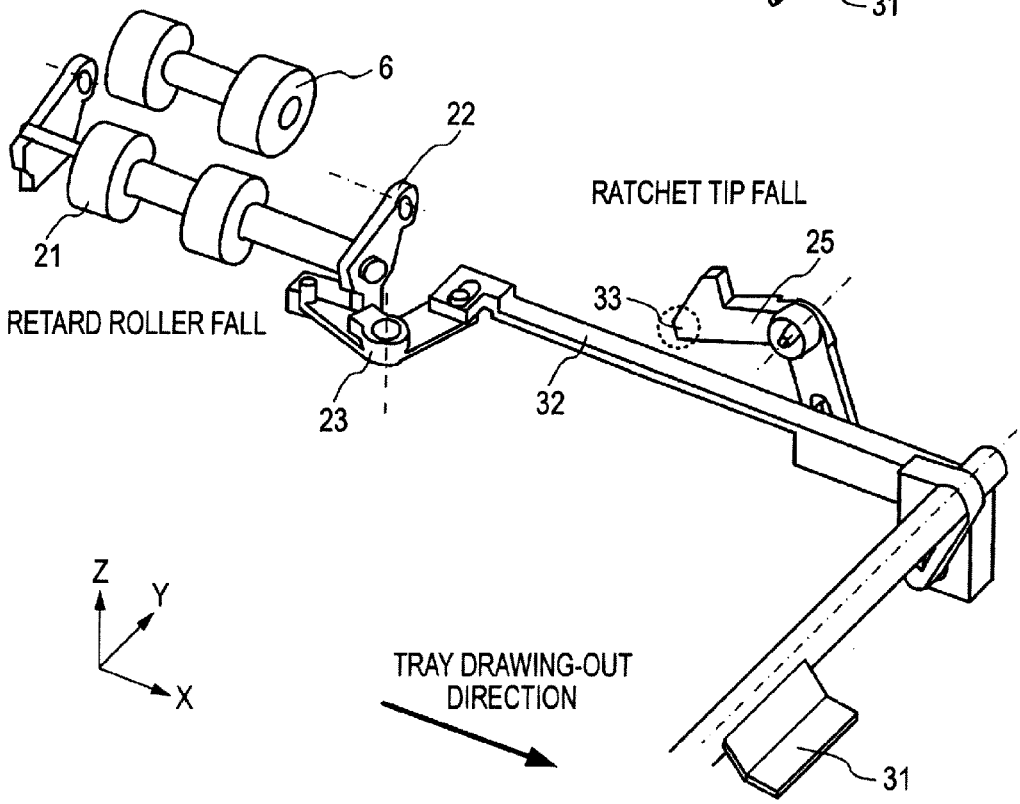

FIG. 15A is a schematic drawing to show the components when the sheet feed tray 20 having the handle 31 is completely housed in the image forming apparatus 1 and the feed roller 6 and the retard roller 21 are in a nip state, and FIG. 15B is a schematic drawing to show the components in a state in which the handle 31 is pulled in the tray drawing-out direction and the nip state between the feed roller 6 and the retard roller 21 is released.

In the sheet feed tray 20 having the handle 31, if the handle 31 is pulled in the tray drawing-out direction from the state in which the sheet feed tray 20 is completely housed in the image forming apparatus 1 and the retard roller 21 and the feed roller 6 are in the nip state as shown in FIG. 15A, the shaft of the handle 31 rotates and causes the component 32 to move in the tray drawing-out direction.

When the component 32 is moved in the tray drawing-out direction, the rotation component 23 makes a rotation move, the assembly 22 falls, and the tip 33 of the ratchet component 25 also falls. Consequently, the nip state of the feed roller 6 and the retard roller 21 is released as shown in FIG. 15B.

Thus, in the sheet feed tray 20 having the handle 31, the handle 31 is pulled in the tray drawing-out direction, whereby the nip state of the feed roller 6 and the retard roller 21 is released, so that when the sheet feed tray 20 is drawn out from the state in which the sheet feed tray 20 is completely housed in the image forming apparatus 1, the handle 31 is pulled in the tray drawing-out direction.

The invention can be used for a feeder and an image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeder that stores a sheet used to form an image in an image forming apparatus main body and that is configured to be drawn out from the image forming apparatus main body in a perpendicular direction to a sheet conveying direction, the feeder comprising:

a separation member that is in press-contact with a sheet feed member disposed in the image forming apparatus main body for separating a stored sheet in cooperation with the sheet feed member;

an arm part that is attached to the separation member, the separation member being rotatably attached through the arm part; and a rotation mechanism that rotates the separation member downward through the arm part and releases the press contact with the sheet feed member when the feeder is drawn out from the image forming apparatus main body, wherein the rotation mechanism includes:

a rotation component that rotates by abutting against a projection part provided in the image forming apparatus main body; and a transmission component that transmits the rotation of the rotation component to the arm part for rotating the separation member downward, and wherein, while the rotation component rotates by the projection part, the rotation mechanism rotates the separation member downward through the arm part and releases the press contact with the sheet feed member when the feeder is drawn out from the image forming apparatus main body.

2. The feeder according to claim 1, wherein the separation member is a retard roller, and the retard roller is detachably attached to the feeder.

3. The feeder according to claim 2, wherein the retard roller and the arm part are detachably attached to the feeder.

4. The feeder according to claim 2, further comprising:

a guide member that guides the sheet; and an open/closing member that is a part of the guide member and provided to an attachment part of the retard roller, wherein the open/closing member rotates on an axis in the perpendicular direction to the sheet conveying direction so as to be opened when the retard roller is taken out, and the open/closing member has an urging unit that adds a force in a closing direction of the open/closing member.

5. A feeder that stores a sheet used to form an image in an image forming apparatus main body and that is configured to be drawn out from the image forming apparatus main body in a perpendicular direction to a sheet conveying direction, the feeder comprising:

a separation member that is in press-contact with a sheet feed member disposed in the image forming apparatus main body for separating a stored sheet in cooperation with the sheet feed member;

an arm part that is attached to the separation member, the separation member being rotatably attached through the arm part;

a rotation mechanism that rotates the separation member downward through the arm part and releases the press contact with the sheet feed member when the feeder is drawn out from the image forming apparatus main body, wherein the separation member is a retard roller, and the retard roller is detachably attached to the feeder, and a guide member that guides the sheet; and an open/closing member that is a part of the guide member and provided to an attachment part of the retard roller, wherein the open/closing member rotates on an axis in the perpendicular direction to the sheet conveying direction so as to be opened when the retard roller is taken out, and the open/closing member has an urging unit that adds a force in a closing direction of the open/closing member, wherein a hole is provided in a side part of the feeder to which the open/closing member is attached, the hole into which a finger is inserted for opening the open/closing member.

6. A feeder that stores a sheet used to form an image in an image forming apparatus main body and that is configured to be drawn out from the image forming apparatus main body in a perpendicular direction to a sheet conveying direction, the feeder comprising:

a separation member that is in press-contact with a sheet feed member disposed in the image forming apparatus main body for separating a stored sheet in cooperation with the sheet feed member;

an arm part that is attached to the separation member, the separation member being rotatable attached through the arm part;

a rotation mechanism that rotates the separation member downward through the arm part and releases the press contact with the sheet feed member when the feeder is drawn out from the image forming apparatus main body, wherein the separation member is a retard roller, and the retard roller is detachably attached to the feeder, and a guide member that guides the sheet; and an open/closing member that is a part of the guide member and provided to an attachment part of the retard roller, wherein the open/closing member rotates on an axis in the perpendicular direction to the sheet conveying direction so as to be opened when the retard roller is taken out, and the open/closing member has an urging unit that adds a force in a closing direction of the open/closing member, wherein the guide member has a notch in an end part of the image forming apparatus main body.

7. The feeder according to claim 1, further comprising:

a grip part operatively associated with the transmission component, wherein the grip part, when the feeder is drawn out from the image forming apparatus main body, is operated for rotating the separation member downward through the arm part for releasing the press contact with the sheet feed member.

8. An image forming apparatus comprising:

an image forming apparatus main body; and a feeder that is attached to the image forming apparatus main body so that the feeder can be drawn out from the image forming apparatus main body in a perpendicular direction to a sheet conveying direction, wherein the image forming apparatus main body comprises: a sheet feed member, the feeder comprises:

a separation member that is in press-contact with the sheet feed member for separating a stored sheet in cooperation with the sheet feed member;

an arm part that is attached to the separation member, the separation member being rotatably attached through an arm part; and a rotation mechanism that rotates the separation member downward through the arm part and releases the press contact with the sheet feed member when the feeder is drawn out from the image forming apparatus main body, wherein the rotation mechanism includes:

a rotation component that rotates by abutting against a projection part provided in the image forming apparatus main body; and a transmission component that transmits the rotation of the rotation component to the arm part for rotating the separation member downward, and wherein, while the rotation component rotates by the projection part, the rotation mechanism rotates the separation member downward through the arm part and releases the press contact with the sheet feed member when the feeder is drawn out from the image forming apparatus main body.

* * * * *